United States Patent [19]

Goff

[11] 4,333,276

[45] Jun. 8, 1982

[54] TUMBLING APPARATUS

[76] Inventor: James R. Goff, Rte. 1 - Box 247AB, Seminole, Okla. 74868

[21] Appl. No.: 134,245

[22] Filed: Mar. 26, 1980

[51] Int. Cl.[3] ..... B24C 3/26

[52] U.S. Cl. ..... 51/422; 241/284

[58] Field of Search ..... 51/418, 426, 163.1, 51/422, 423; 198/843, 837, 833; 241/284

[56] References Cited

U.S. PATENT DOCUMENTS

| | | | |
|---|---|---|---|
| 2,357,599 | 9/1944 | Mott | 51/422 |
| 2,563,084 | 8/1951 | Turnbull | 51/423 |
| 3,082,857 | 3/1963 | Holloman | 198/837 X |
| 3,669,238 | 6/1972 | Folkes | 198/837 X |
| 3,715,840 | 2/1973 | Davidson | 51/163.1 |
| 3,735,532 | 5/1973 | Long | 51/418 |
| 3,869,574 | 3/1975 | Kume | 198/837 X |

FOREIGN PATENT DOCUMENTS

| | | | |
|---|---|---|---|
| 197712 | 8/1977 | U.S.S.R. | 198/837 |

*Primary Examiner*—Nicholas P. Godici

*Attorney, Agent, or Firm*—Beveridge, DeGrandi, Kline & Lunsford

[57] ABSTRACT

A tumbling apparatus for use in drum blast machines has a first endless belt defining a pocket for receiving workpieces to be tumbled and blast cleaned by abrasive projected at high speed against the workpieces. As the workpieces are tumbled by the belt, they fall onto a portion of the pocket called the cascade zone. A second endless belt is provided underneath the cascade zone of the pocket to give support to the first belt while preventing any anvil pinching of the first belt.

9 Claims, 2 Drawing Figures

TUMBLING APPARATUS

BACKGROUND OF THE INVENTION

The present invention relates to tumbling apparatus, and is particularly well suited for use in drum blast apparatus, i.e., tumbling apparatus used in combination with abrasive blasting equipment.

It has been known for some time to use various endless conveyors to tumble workpieces in a mill. Typical devices are disclosed in U.S. Pat. No. 1,833,301 to L. D. Peik and U.S. Pat. No. 3,585,758 to Willard J. Harper. These devices relate to conveyors made of segmented links, which are usually made of metal.

More recently, the art has recognized the utility of elastomer belts, such as disclosed in U.S. Pat. No. 3,715,840 to Davidson. In the Davidson patent an elastomer belt is driven to provide a tumbling effect; however, the tension on the belt is adjusted to support workpieces without requiring any additional underlying support during tumbling. Although a V-shaped belt guide is provided underneath the belt, the patentee teaches that the belt is ideally not in contact with the belt guide while in operation.

It is known to support elastomer tumbling belts by providing resiliently coated support idler rollers underneath the weight-bearing portion of the driven belt. It has been necessary to provide the resilient coating on these idler support rollers to prevent the metal support roller from acting as an anvil. Without the coating, the falling workpieces cause pinching and cutting of the belt vastly decreasing its useful life. Furthermore, it has been found that a multiplicity of resiliently coated idler support rollers are required to give the necessary support along an adequate length of the belt. The resiliently coated idler support rollers are expensive and multiples of them greatly add to the cost of conventional apparatus.

Accordingly, it can be seen that there is a need in the art for an easily constructed, inexpensive drum blast apparatus having a support for a main driven elastomer belt, which does not cause pinching or cutting of the main belt, and which does not unduly add to the expense of the apparatus.

SUMMARY OF THE INVENTION

The present invention aids in fulfilling these needs by providing a tumbling apparatus for tumbling workpieces in a drum blast machine. The apparatus includes a frame, a first roller rotatably mounted in the frame, a second roller spaced from the first roller and rotatably mounted in the frame, a first endless belt mounted circumferentially around the first and second rollers thereby defining an outer surface of the first belt and defining an upwardly opening pocket on the outer surface of the first belt for receiving the workpieces, means for driving the first belt, a third roller spaced from the first and second rollers rotatably mounted in the frame and located below the pocket, a second endless belt mounted circumferentially around the second and third rollers and located within the first endless belt so that the second belt is in supporting contact with the first belt underneath a portion of the pocket. The first and second belts can be made of elastomeric material, such as rubber. The tumbling apparatus can be further provided with an abrasive blasting device oriented to project abrasive material at abrading velocities toward the workpieces in the pocket. The apparatus can also include fourth and fifth rollers rotatably mounted in the frame within the first belt below the pocket for spacing the first belt away from the pocket on its return path toward the first roller. The second and fourth rollers can be adjustably mounted in the frame so that tension on the first and second belts can be varied. Since the predominant proportion of the workpieces fall onto a portion of the first belt known as the cascade zone, the location of the second belt supporting the first belt is preferably underneath the cascade zone.

BRIEF DESCRIPTION OF THE DRAWINGS

The invention will be better understood by reading the following detailed description along with a study of the drawings wherein.

DETAILED DESCRIPTION OF THE INVENTION

Figure 1:
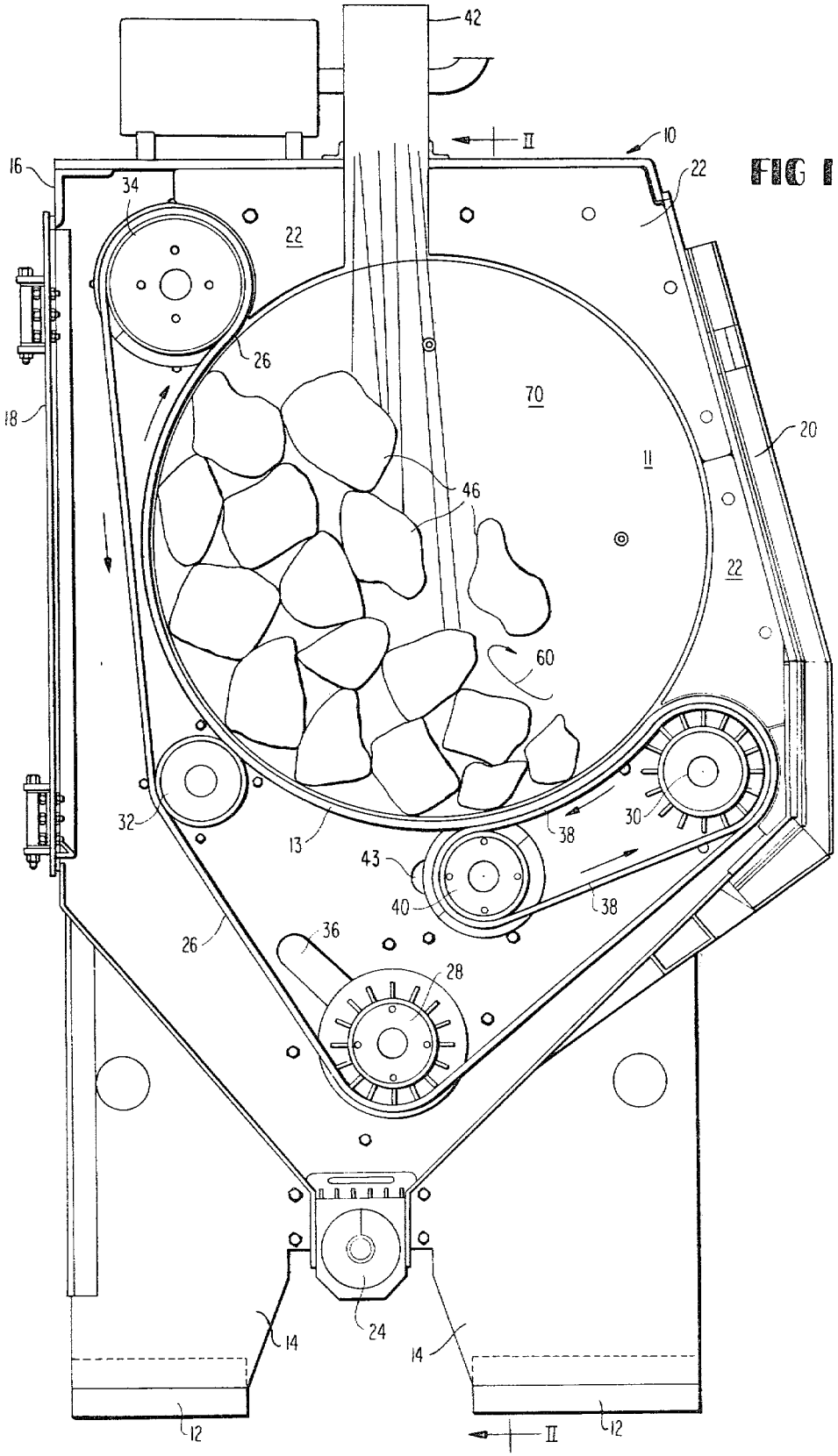
FIG. 1 shows a sectional view of the interior of a tumbling apparatus according to this invention taken along line I—I of FIG. 2.

Referring to FIG. 1, a tumbling apparatus 10 includes a frame 16 mounted on legs 14, which have feet 12. Frame 16 has a rear door 18 and a front door 20. Doors 18 and 20 are of conventional tumbling mill construction with door 20 providing access to the interior 11 for loading and unloading of workpieces 46. Such workpieces can be any articles, the tumbling of which (with or without abrasive blasting) is desired, such as metallic castings. Door 18 provides access for service of the interior components of apparatus 10. Frame 16 can take the embodiment of a cabinet enclosing the components hereinafter described. The interior of frame 16 has liner plates 22, which are readily replaceable when worn.

A series of four rollers 28, 30, 32 and 34 are rotatably mounted, such as by journalling in frame 16. A first main belt 26, typically made of an elastomeric material, preferably rubber, is mounted peripherally around these four rollers. Belt 26 is an endless belt long enough to circumscribe the rollers and define an upwardly opening pocket 13 to receive the workpieces 46 to be tumbled. It can be seen that the pocket 13 is defined by the top portion of belt 26 suspended between rollers 30 and 34. Rollers 28 and 32 space the belt 26 away from the pocket on its return path toward roller 30.

An additional roller 40 is provided underneath the pocket 13 proximate to main belt 26. Resilient support belt 38 is mounted on the periphery of rollers 30 and 40 so that it contacts main belt 26 underneath a portion of the pocket 13. The resiliency of support belt 38 should be sufficient to provide a cushion between the main belt 26 and the rollers 30 and 40 to minimize the aforementioned anvil effect. A suitable resilient material would be rubber or other elastomeric material. As can be seen, both belts 26 and 38 are mounted on the roller 30. The two belts on roller 30 provide enough resiliency to minimize anviltype pinching or cutting of belt 26 from improper loading of workpieces into the apparatus through door 20.

Rollers 40 and 28 are adjustably journaled in slots 43 and 36, respectively, so that the tension on belts 38 and 26 can be adjusted for optimum operating conditions and to compensate for stretching of the belts.

An abrasive blasting device 42 can advantageously be housed in the upper portion of device 10 by mounting on frame 16 to direct a stream of abrasive material at high speed onto the workpieces 46 held in the pocket. It is understood that the blasting device may be of the air or airless type. A screw conveyor 24 can be provided to discharge any spent abrasive or foreign material removed from the workpieces that falls to the bottom of the apparatus. The spent abrasive and foreign material can then be recovered and the abrasive cleaned and recycled to abrasive blasting device 42. When the abrasive blasting device 42 is employed, the frame 16 should preferably take the aforementioned embodiment of a cabinet to prevent the escape of abrasive.

Figure 2:
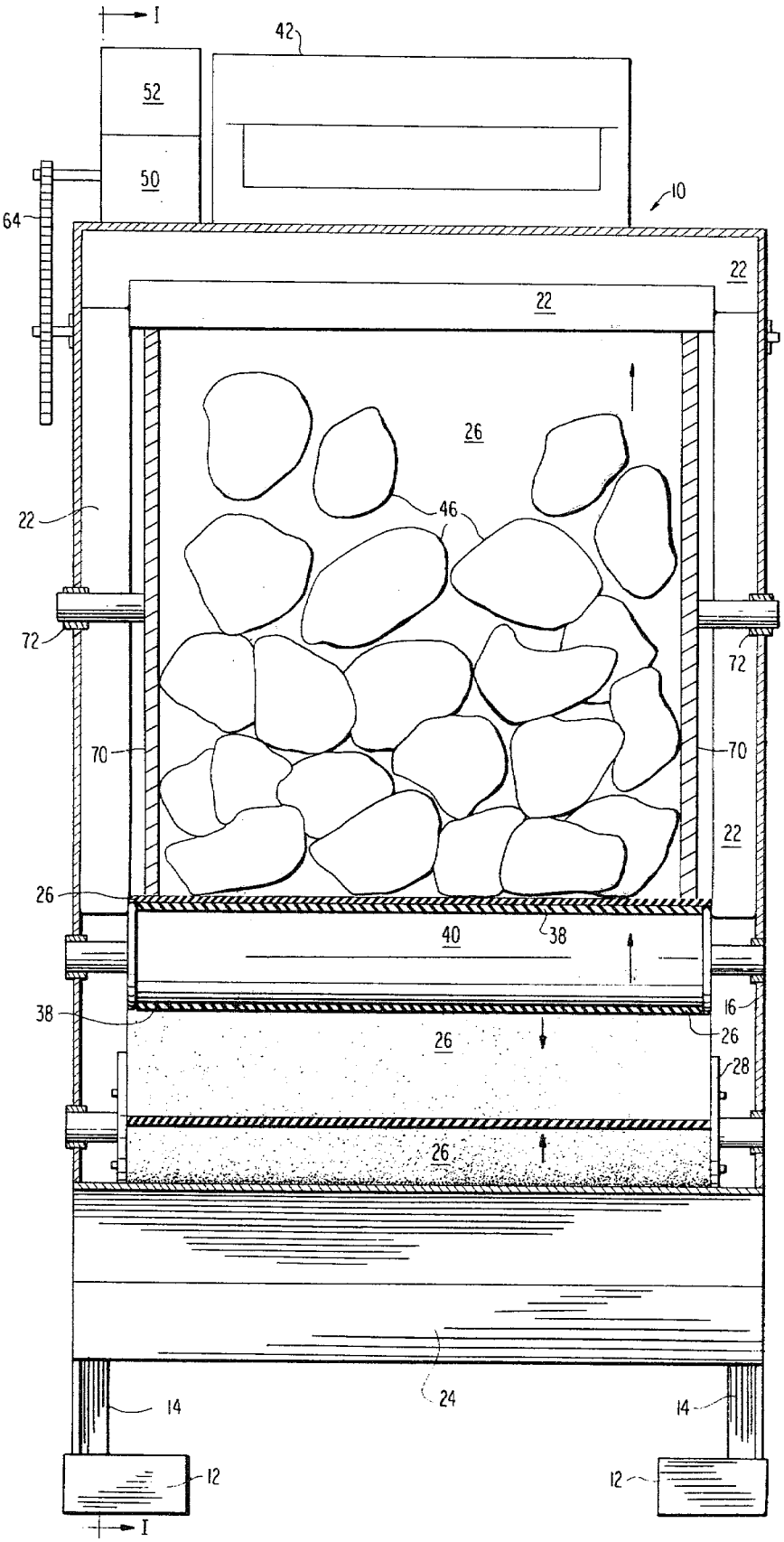
FIG. 2 shows a sectional view of an apparatus according to this invention taken along line II—II of FIG. 1.

As seen in FIG. 2, drive motor 52 is provided to cause roller 34 to rotate thereby driving main belt 26 around the path defined by the locus of belt 26. Drive motor 52 is linked to roller 34 through speed reducing gears 50 and drive chain 64.

The ends of the pocket 13 are bounded by barrel heads 70, rotatably mounted at 72 in frame 16.

Referring again to FIG. 1, the operation of the apparatus will be readily seen. Roller 34 rotates counterclockwise driving belt 26 in the direction of the arrows adjacent to it. Frictional contact between belt 26 and belt 38 causes belt 38 to travel in the direction of the arrows adjacent to it in FIG. 1. It will be understood that belt 38 can also be independently driven. The motion of belt 26 causes the workpieces 46 to tumble in the direction of arrow 60. The tumbling of workpieces 46 causes them to cascade onto a cascade zone which is supported by belt 38. The term "cascade zone" means that portion of the main drive belt 26 onto which the predominant proportion of workpieces fall during tumbling operations and the workpieces supported by that portion of the main drive belt.

Preferably, the additional support belt 38 is made of elastomeric material so that it acts as a cushion between belt 26 and roller 40 to thereby substantially prevent falling workpieces from pinching or cutting belt 26. Additionally, it is preferred that belt 38 afford substantially continuous support for belt 26 throughout the cascade zone, thereby eliminating the need for additional rollers. The direction of motion of the belts and rollers can also be seen in FIG. 2 from the direction of the arrows on belt 26 and roller 40.

Thus, the present invention provides continuous support for the main belt in the cascade zone without the need of unnecessary expensive resiliently coated idler rollers.

I claim:

1. A tumbling apparatus for tumbling workpieces comprising:

a frame, a first roller rotatably mounted in said frame, a second roller spaced from said first roller and rotatably mounted in said frame, a first endless belt mounted circumferentially around said first and second rollers thereby defining an outer surface of said first belt and defining an upwardly opening pocket on the outer surface of said first belt for receiving said workpieces, means for driving said first belt, a third roller spaced from said first and second rollers rotatably mounted in said frame and located below said pocket, a second endless belt mounted circumferentially around said second and third rollers and located within said first endless belt so that said second belt is in supporting contact with said first belt underneath a portion of said pocket.

2. A tumbling apparatus as claimed in claim 1 wherein said first and second belts are made of rubber.

3. A tumbling apparatus as claimed in claim 1 wherein said first and second belts are made of elastomeric material.

4. A tumbling apparatus as claimed in claim 3 further comprising an abrasive blasting device oriented to project abrasive material at abrading velocities toward said workpieces in said pocket.

5. A tumbling apparatus as claimed in either claim 1 or claim 4 further comprising fourth and fifth rollers rotatably mounted in said frame within said first belt below said pocket for spacing said first belt away from said pocket on its return path toward said first roller.

6. A tumbling apparatus as claimed in claim 5 wherein said third and fourth rollers are adjustably mounted in said frame so that the tension on said first and second belts can be varied.

7. A tumbling apparatus as claimed in claim 6 wherein the tumbling of said workpieces causes them to fall into a cascade zone and wherein said second belt supports said first belt under said cascade zone.

8. A tumbling apparatus as claimed in claim 1 further comprising first and second barrel heads rotatably mounted in said frame bounding said ends of said pocket.

9. A tumbling apparatus for tumbling workpieces comprising:

a frame, a first roller rotatably mounted in said frame, a second roller spaced from said first roller and rotatably mounted in said frame, a first endless belt mounted circumferentially around said first and second rollers thereby defining an outer surface of said first belt and defining an upwardly opening pocket on the outer surface of said first belt for receiving said workpieces, first and second barrel heads rotatably mounted in said frame bounding the ends of said pocket, means for driving said first belt, a third roller spaced from said first and second rollers rotatably mounted in said frame and located below said pocket, a second endless belt mounted circumferentially around said second and third rollers and located within said first endless belt so that said second belt is in supporting contact with said first belt underneath a portion of said pocket, an abrasive blasting device oriented to project abrasive material at abrading velocities toward said workpieces in said pocket, wherein said frame includes a cabinet for preventing the escape of abrasive.

* * * * *